US007422474B1

(12) United States Patent
Good

(10) Patent No.: US 7,422,474 B1
(45) Date of Patent: Sep. 9, 2008

(54) BATTERY TERMINAL CLAMPING DEVICE

(76) Inventor: Mark D. Good, 513 Indian Ridge Trail, Wauconda, IL (US) 60084

( * ) Notice: Subject to any disclaimer, the term of this patent is extended or adjusted under 35 U.S.C. 154(b) by 0 days.

(21) Appl. No.: 11/942,846

(22) Filed: Nov. 20, 2007

(51) Int. Cl.
*H01R 11/00* (2006.01)

(52) U.S. Cl. ..... 439/504; 439/506; 439/822

(58) Field of Classification Search ..... 439/540, 439/506, 822, 829
See application file for complete search history.

(56) References Cited

U.S. PATENT DOCUMENTS 4,153,321 A * 5/1979 Pombrol ..... 439/437
4,620,767 A 11/1986 Woolf
4,781,629 A * 11/1988 Mize ..... 439/822
4,923,415 A 5/1990 Lee
5,634,814 A * 6/1997 Krivec ..... 439/441
5,772,468 A 6/1998 Kowalski et al.
5,928,022 A * 7/1999 Moeller ..... 439/197
6,386,907 B1 5/2002 Ruffa
2006/0223384 A1 10/2006 Schuh

OTHER PUBLICATIONS

Coleman Cable Inc., Automotive Catalog, Oct. 2007, 1-31 pages, Waukegan, Illinois.

* cited by examiner

*Primary Examiner*—Hien Vu
(74) *Attorney, Agent, or Firm*—Greenberg Traurig LLP

(57) ABSTRACT

A terminal clamping device has a first and second gripping members that are pivotably connected to each other about an axis in offset relation. Electrically conductive jaw members carried by each of the first and second gripping members are each provided with a side having an outwardly extending jog such that terminal gripping edges of the jaw members will be properly aligned when the terminal clamping device is disposed upon a battery terminal.

8 Claims, 3 Drawing Sheets

BATTERY TERMINAL CLAMPING DEVICE

BACKGROUND

Battery terminal clamping devices are known in the art. By way of example, U.S. Pat. Nos. 6,386,907, 5,772,468, 4,923,415, and 4,620,767, as well as U.S. Published Application No. 2006/0223384, which are incorporated herein by reference in their entirety, illustrate and describe an automotive battery jumper cable that includes an electrically conductive cable which is terminated at each end by a terminal clamping device. Each of the terminal clamping devices includes a pair of gripping members each having a jaw end and a handle end. The gripping members are pivotably connected to each other about an axis between the jaw ends and the handle ends. A spring is mounted on the gripping members for normally urging the jaw ends toward each other. At least one of the jaw ends of the gripping members is provided with an electrically conductive jaw member for engaging and grasping a battery terminal.

SUMMARY

A novel battery terminal clamping device is hereinafter described. More particularly, the following describes a terminal clamping device having a first gripping member having a first jaw end and a first handle end and a second gripping member having a second jaw end and a second handle end. Secured to the first jaw end of the first gripping member is a first electrically conductive jaw member and secured to the second jaw end of the second gripping member is a second electrically conductive jaw member. The first gripping member and the second gripping member are pivotably connected to each other about an axis in offset relation such that, on a first side of the terminal clamping device, a portion of a first side of the first gripping member overlays a portion of a first side of the second gripping member and, on an opposite side of the terminal clamping device, a portion of a second side of the second gripping member overlays a portion of a second side of the first gripping member. To ensure that terminal gripping edges of the first jaw member and second jaw member will be properly aligned when the terminal clamping device is disposed upon a battery terminal post a side of the first electrically conductive member that is in correspondence with the second side of the first gripping member is provided with an outwardly extending jog and a side of the second electrically conductive member that is in correspondence with the first side of the second gripping member is provided with an outwardly extending jog.

A better understanding of the objects, advantages, features, properties and relationships of the novel battery terminal clamping device will be obtained from the following detailed description and accompanying drawings which set forth an illustrative embodiment and which are indicative of the various ways in which the principles of the invention may be employed.

BRIEF DESCRIPTION OF THE DRAWINGS

For a better understanding of the battery terminal clamping device reference may be had to the following drawings in which.

DETAILED DESCRIPTION

Figure 1:
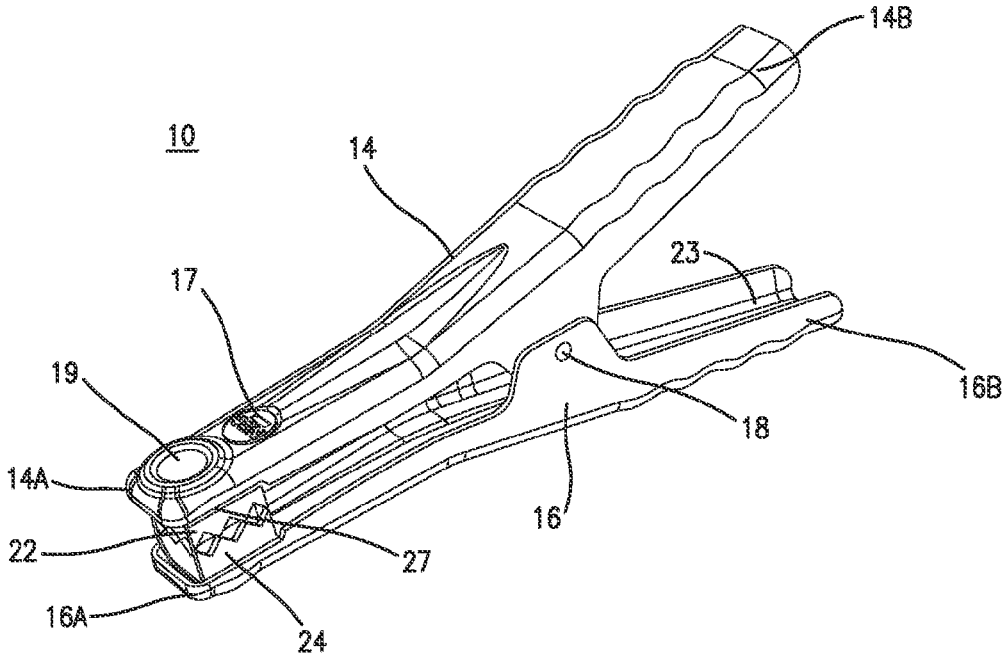
FIG. 1 is a front perspective view showing an exemplary battery terminal clamp constructed in accordance with the inventive concepts.
Figure 2:
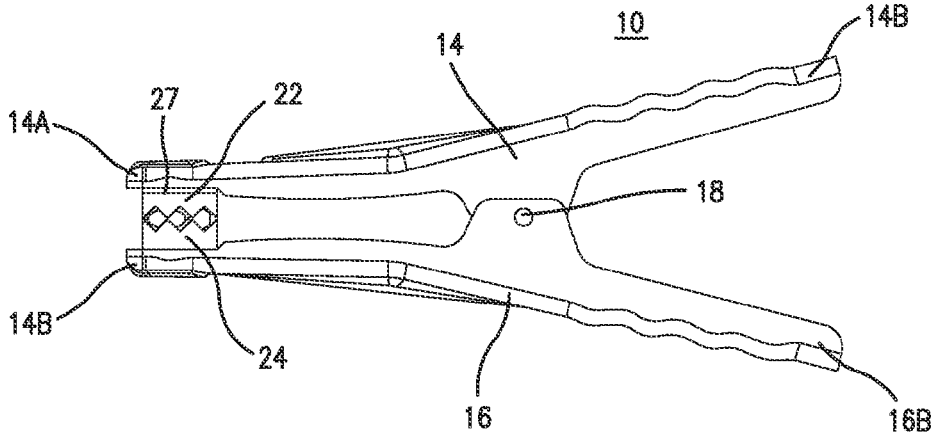
FIG. 2 is a left side elevational view of the exemplary battery terminal clamp of FIG. 1.
Figure 3:
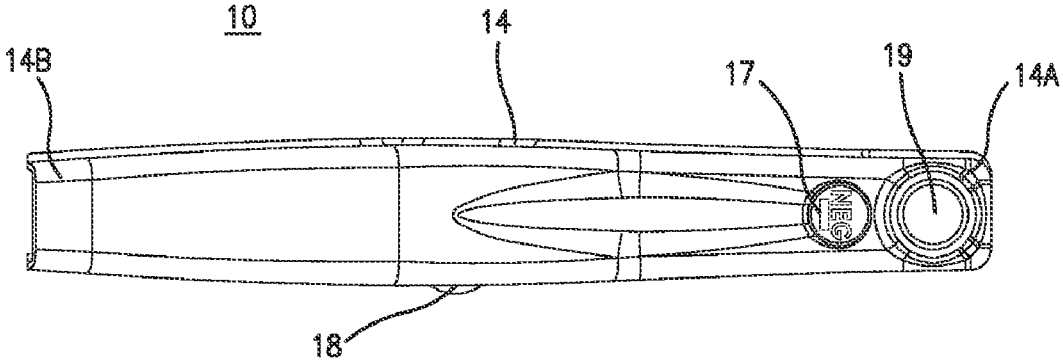
FIG. 3 is a top plan view of the exemplary battery terminal clamp of FIG. 1.
Figure 4:
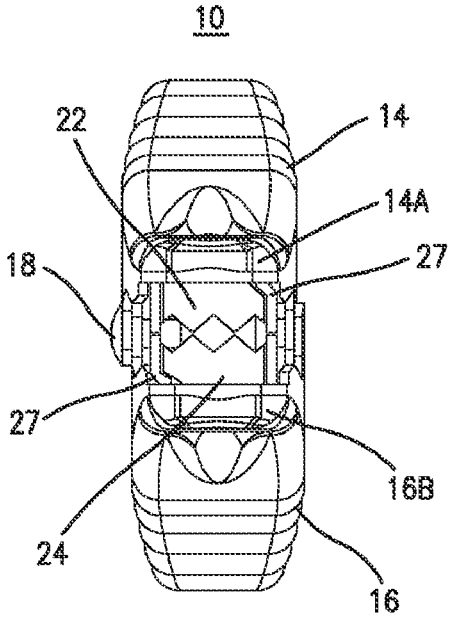
FIG. 4 is a front elevational view of the exemplary battery terminal clamp of FIG. 1.
Figure 5:
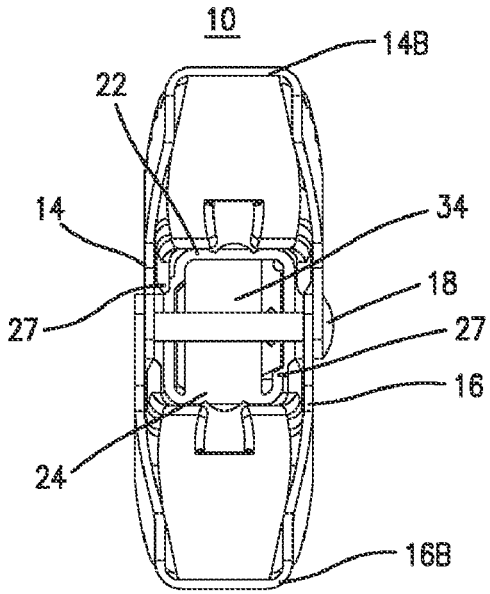
FIG. 5 is a rear elevational view of the exemplary battery terminal clamp of FIG. 1.
Figure 6:
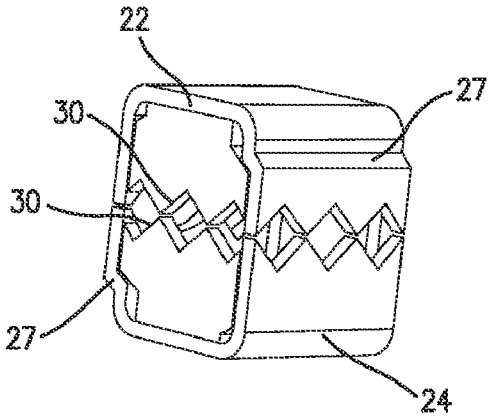
FIG. 6 is a front perspective view of exemplary conductive jaw members of the exemplary battery terminal clamp of FIG. 1.
Figure 7:
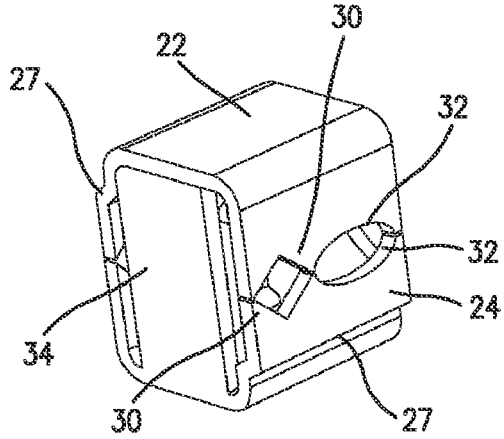
FIG. 7 is a rear perspective view of the exemplary conductive jaw members of FIG. 6.
Figure 8:
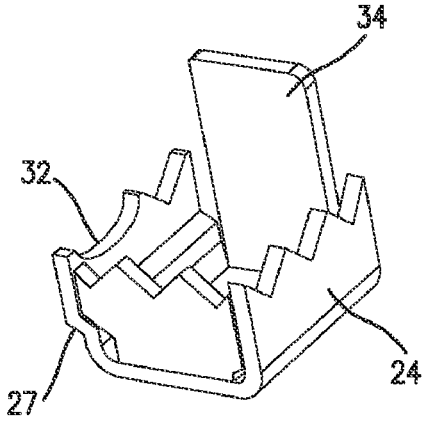
FIG. 8 is a front perspective view of an exemplary lower one of the exemplary conductive jaw members of FIG. 6.
Figure 9:
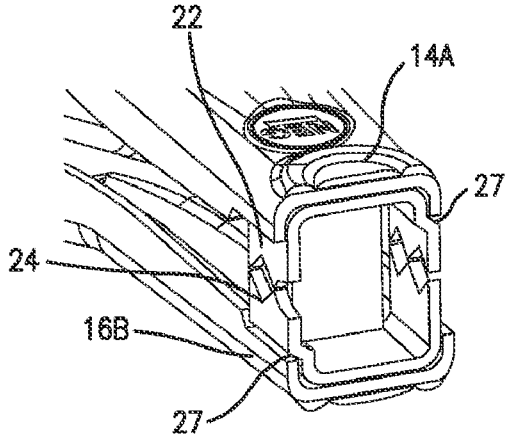
FIG. 9 is a cross-sectional view of the exemplary battery terminal clamp of FIG. 1.

Referring now to the figures, a novel battery terminal clamping device 10 is hereinafter described. As will be appreciated, the battery terminal clamping device 10 may be utilized in a conventional jumper or booster cable assembly, i.e., an insulated, electrically conductive cable or wire which is terminated at each end by one of the battery terminal clamping devices 10.

More particularly, the battery terminal clamping device 10 is comprised of a pair of gripping members 14 and 16 with each of the gripping members having a respective jaw end 14A and 16A and a respective handle end 14B and 16B. The gripping members 14 and 16 may be constructed from vinyl coated stamped steel, high-strength reinforced plastic, or the like and may be provided with desired ergonomic features, such as contoured finger accepting portions provided to the handle ends 14B and 16B, and a length that is appropriate for a given application. The gripping members 14 and 16 are pivotably connected to each other by one or more pivot pins 18 which forms a pivot axis positioned between the jaw ends 14A and 16A and the respective handle ends 14B and 16B. A torsion spring or the like, not illustrated, may be positioned around the pivot pin(s) 18 such that it is operative for normally urging the jaw ends 14A and 16A toward each other. As shown in the figures, the gripping members 14 and 16 are further offset with respect to each other owing to their like construction, e.g., on the left hand side of the battery terminal clamping device 10 a portion of a first side of the gripping member 14 overlays a portion of a first side of the gripping member 16 in the area of the pivot point while on the right hand side of the battery terminal clamping device 10 a portion of a second side of the gripping member 16 overlays a portion of a second side of the gripping member 14 in the area of the pivot point. One or more of the gripping members 14 and 16 may also be provided with a polarity indicating indicia 17, such as a glow-in-the-dark sticker or the like.

Each of the jaw ends 14A and 16A of the respective gripping members 14 and 16 is provided with a jaw member 22 and 24 for engaging and grasping a battery terminal. The jaw members 22 and 24 may be constructed from copper-coated stamped steel, pure copper, or the like and may be attached to their respective gripping member 14 and 16 through use of a high-strength steel rivet 19 or equivalent. As will be appreciated, at least one of the jaw members 22 and 24 would be electrically connected to the cable of the jumper or booster cable which jumper or booster cable may further be positioned within a trough 23 formed in the gripping members 14 and 16. A loop or other tie-down mechanism may also be provided to maintain the cable within the trough 23.

The jaw members 22 and 24 are further adapted to facilitate reliable mechanical connection and to provide a sure electrical interface with a battery terminal. To this end, one side of the jaw members 22 and 24 may be provided with teeth 30 as well an oval feature 32. The oval features 32 of the jaw members 22 and 24 cooperate to allow the battery terminal clamping device 10 to be easily connected to a side terminal found on certain batteries while the teeth 30 of the jaw members 22 and 24 cooperate to allow the battery terminal clamping device 10 to be conventionally connected to a top terminal of a battery. The opposite side of the jaw members 22 and 24 as well as the front of the jaw members 22 and 24 may be similarly provided with cooperating teeth 30 again for use in conventionally connecting the battery terminal clamping device 10 to a battery terminal. Still further, one of the jaw members 22 and 24 may be provided with a stop plate 34, positioned at the rear of the jaw member and adapted to engage the underside of the other of the jaw members 22 or 24, for use in preventing the battery terminal clamping device 10 from being connected to deeply upon a battery terminal as well as to limit the closing of the battery terminal clamping device 10. As additionally shown in the figures, an outward jog 27 is also provided to a side of each of the jaw members 22 and 24 such that the terminal gripping edges of the jaw members 22 and 24 will be properly aligned on a battery terminal despite the gripping members 14 and 16 being offset with respect to each other as described above. More particularly, the outward jog 27 is provided on the side of the jaw member 22 and 24 that is in correspondence to the side of its respective gripping member 14 and 16 that is in the interiorly disposed, overlapping relation with respect to the other of the gripping member 14 and 16 in the area of the pivot connection.

While a specific embodiment of a terminal clamping device has been described in detail, it will be appreciated by those skilled in the art that various modifications and alternatives to those details could be developed in light of the overall teachings of the disclosure. Accordingly, the particular arrangement disclosed is meant to be illustrative only and not limiting as to the scope of the invention which is to be given the full breadth of the appended claims and any equivalents thereof.

What is claimed is:

1. A terminal clamping device, comprising:

a first gripping member having a first jaw end and a first handle end;

a second gripping member having a second jaw end and a second handle end;

a first electrically conductive jaw member secured to the first jaw end of the first gripping member; and a second electrically conductive jaw member secured to the second jaw end of the second gripping member;

wherein the first gripping member and the second gripping member are pivotably connected to each other about an axis in offset relation such that, on a first side of the terminal clamping device, a portion of a first side of the first gripping member overlays a portion of a first side of the second gripping member and, on an opposite side of the terminal clamping device, a portion of a second side of the second gripping member overlays a portion of a second side of the first gripping member; and wherein a side of the first electrically conductive member that is in correspondence with the second side of the first gripping member is provided with an outwardly extending jog and a side of the second electrically conductive member that is in correspondence with the first side of the second gripping member is provided with an outwardly extending jog such that terminal gripping edges of the first jaw member and second jaw member will be properly aligned when the terminal clamping device is disposed upon a battery terminal;

wherein one of the first jaw member and the second jaw member comprises a stop plate which extends upwardly between the first and second jaw members and being positioned away from front ends of the first and second jaw members.

2. The terminal clamping device as recited in claim 1, wherein the terminal gripping edges of the first jaw member and the second jaw member comprises cooperating teeth.

3. The terminal clamping device as recited in claim 2, wherein the first jaw member and the second jaw member each comprise cooperating oval shaped portions for placing the terminal clamping device on a side battery terminal.

4. The terminal clamping device as recited in claim 1, wherein the first jaw member and the second jaw member comprises a copper material.

5. The terminal clamping device as recited in claim 4, wherein the first gripping member and the second gripping member comprises a plastic material.

6. The terminal clamping device as recited in claim 5, wherein the first handle end of the first gripping member and the second handle end of the second gripping member each comprise cooperating recesses and ridges for providing ergonomic hand grips.

7. The terminal clamping device as recited in claim 6, wherein at least one the first gripping member and the second gripping member carries an indicia of polarity.

8. The terminal clamping device as recited in claim 1, wherein the outwardly extending jog of the side of the first jaw member is disposed adjacent to the first jaw end of the first gripping member and the outwardly extending jog of the side of the second jaw member is disposed adjacent to the second jaw end of the second gripping member.

* * * * *